US006179337B1

(12) United States Patent
Zumberge

(10) Patent No.: US 6,179,337 B1
(45) Date of Patent: Jan. 30, 2001

(54) BUSINESS CARD WITH PEEL OFF LABELS

(75) Inventor: Gary Zumberge, Edina, MN (US)

(73) Assignee: Capture Business Cards, LLC, Edina, MN (US)

( * ) Notice: Under 35 U.S.C. 154(b), the term of this patent shall be extended for 0 days.

(21) Appl. No.: 09/206,886

(22) Filed: Dec. 8, 1998

Related U.S. Application Data

(63) Continuation-in-part of application No. 08/986,867, filed on Dec. 8, 1997, now abandoned.

(51) Int. Cl.[7] ..... B42D 15/00

(52) U.S. Cl. ..... 283/81; 281/2; 281/8; 281/10; 281/15; 281/81; 283/79; 283/98; 283/99; 283/100; 283/101; 283/116

(58) Field of Search ..... 283/81, 101, 100, 283/116, 98, 99, 79; 281/2, 8, 10, 15, 12, 81

(56) References Cited

U.S. PATENT DOCUMENTS

| | | | | |
|---|---|---|---|---|
| 4,890,862 | | 1/1990 | Buchholz | 283/62 |
| 4,905,392 | | 3/1990 | Klein | 40/638 |
| 4,945,218 | | 7/1990 | Talbott | 235/487 |
| 5,044,667 | * | 9/1991 | Berry | 283/81 |
| 5,098,129 | * | 3/1992 | Haber | 283/62 |
| 5,165,726 | * | 11/1992 | Talbott | 283/81 |
| 5,209,514 | | 5/1993 | Hebert | 283/81 |
| 5,232,248 | | 8/1993 | Talbott | 283/81 |
| 5,257,823 | | 11/1993 | Colvin, Jr. et al. | 283/117 |
| 5,282,649 | | 2/1994 | Williams et al. | 283/56 |
| 5,299,835 | | 4/1994 | Sonnenberg | 253/56 |
| 5,318,825 | | 6/1994 | Naber | 428/192 |
| 5,328,409 | | 7/1994 | Marquardt | 462/17 |
| 5,342,665 | | 8/1994 | Krawitz | 428/40 |
| 5,352,155 | | 10/1994 | Fahey | 462/25 |
| 5,403,236 | | 4/1995 | Greig | 462/6 |
| 5,408,950 | | 4/1995 | Porto | 116/239 |
| 5,413,532 | | 5/1995 | Raby | 432/2 |
| 5,421,779 | * | 6/1995 | Castro | 462/8 |
| 5,427,832 | | 6/1995 | Longtin | 428/40 |
| 5,462,488 | | 10/1995 | McKillip | 462/26 |
| 5,509,693 | | 4/1996 | Kohls | 283/75 |
| 5,529,345 | | 6/1996 | Kohls | 283/75 |
| 5,534,320 | | 7/1996 | Raby | 428/42.1 |
| 5,622,761 | | 4/1997 | Cole | 428/41.9 |
| 5,640,447 | | 6/1997 | Fonseca | 379/144 |
| 5,673,943 | * | 10/1997 | Campbell | 283/79 |
| 5,839,763 | | 11/1998 | McCannel | 283/109 |

* cited by examiner

*Primary Examiner*—Stephen F. Gerrity
*Assistant Examiner*—Daniel Phan
(74) *Attorney, Agent, or Firm*—Fredrikson & Byron, P.A.

(57) ABSTRACT

A business card assembly having a standard wallet-sized card with top and bottom surfaces. Business card identification information is printed on the top surface. Two or more adhesive-backed removable labels are secured to the bottom surface of the business card, and each of these labels has the business card identification information printed on it. The labels may be peeled off and placed, for example, in one's personal planner, file, or other convenient location. The card may be a traditional flat style, or a tent style. The card may also include a release liner beneath the removable labels, the release liner also optionally including additional printed information.

7 Claims, 5 Drawing Sheets

BUSINESS CARD WITH PEEL OFF LABELS

RELATED APPLICATIONS

This application is a continuation in part of application Ser. No. 08/986,867, filed Dec. 8, 1997, now abandoned.

TECHNICAL FIELD

The invention relates to business cards, and, in particular, to business cards having removable labels.

BACKGROUND OF THE INVENTION

A wide variety of devices and systems have been proposed for organizing and storing business cards. Many business people receive a number of business cards from a variety of sources as they conduct their business activities. For many people, the business cards are simply dropped in a drawer or left in a pile somewhere on or in a desk, the information on the cards thus being available only with some searching and effort. Other times a business card will be taped in a particular location, such as a file, a personal planner, etc. While this makes the information on the card available when that particular file or planner is being used, the information is not otherwise available or readily at hand, since the business card is essentially a "one use" device—i.e., it presents information in only one place.

One solution proposed for handling business cards is a business card folder or notebook containing, for example, pages of transparent pockets into which cards may be inserted. While these types of organizers can be used to organize the cards, they again present the information only in one place. Many business people do not find the time to maintain such dedicated card organizers. Even with such an organizer, if one needs the information to be available in more than one location, it must be manually copied from the business card to, e.g., a contact list in a personal planner, personal phone list, a file folder, etc.

Business people who work out of more than one office (e.g., either branch locations or even a home office) also experience frustration in not having business card information readily available at each of their office locations. Unless they are very conscientious about maintaining a business card organizer and keeping it with them at all times, they often will find that the information they need is on a business card located at one of their other offices.

SUMMARY OF THE INVENTION

The invention provides a multiple-use business card assembly having a standard wallet-sized card with top and bottom surfaces. Business card identification information is printed on the top surface. Two or more adhesive-backed removable labels are secured to the bottom surface of the business card, and each of these labels has the business card identification information printed on it. Thus, when a person receives the business card, they may peel off one of the removable labels and place it, for example, in their personal planner. Another label may be peeled off and placed, for example, in a file relating to the person identified on the business card. Yet another label may be peeled off and placed, for example, on a conventional ROLODEX®-style card. The business card itself is still intact, and may be placed in a business card organizer, in the proverbial pile of cards on one's desk, or in any other convenient location. The business card may be of the conventional flat type, or may be of a folded tent-type. The card may also include a release liner beneath the removable labels, the release liner also optionally including additional printed information.

DETAILED DESCRIPTION OF THE INVENTION

Figure 1:
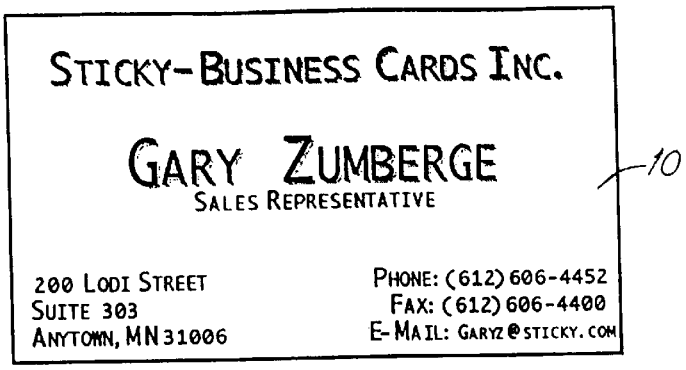
FIG. 1 is a plan view of the top surface of a representative business card of the invention.

FIG. 1 illustrates the top surface of a representative multiple-use wallet-sized business card 10 having the typical business identification information on it. This information includes a company name, an individual's name and title, a mailing address, phone and fax numbers and an e-mail address. Obviously not all of such identification information need be printed on the card, and other additional information may be included (such as a company logo, home phone, etc.), depending on the desires and needs of the particular individual. Nevertheless, sufficient identification information is printed on the card to make it useful as a business card. Such cards are typically about 2 inches by about 3.5 inches in size, and would not exceed 2.25 by 3.75 inches.

Figure 2:
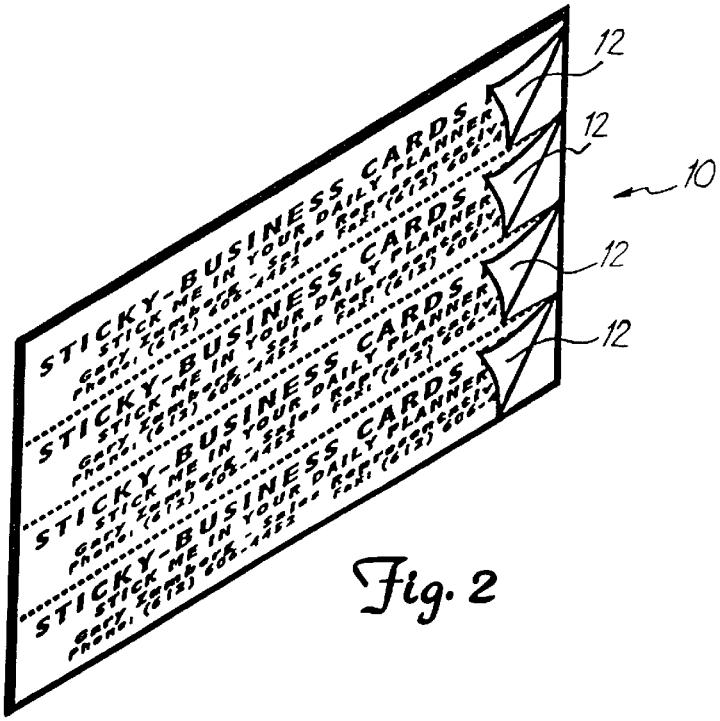
FIG. 2 is a perspective view showing the bottom surface of the business card of FIG. 3.
Figure 3:
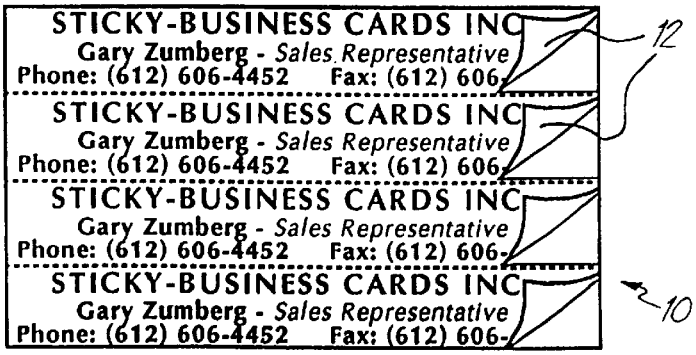
FIG. 3 is a plan view of the bottom surface of the business card of FIG. 1.

FIGS. 2–3 illustrate the bottom surface of the multiple-use business card 10 of FIG. 1. Four peel-off labels 12 have been secured to the back of the business card. Each of the labels 12 has business card identification information printed on it. The information on each label 12 may not necessarily include all of the information printed on the top surface of the card 10, but enough of the information is used to at least identify the individual and, desirably how the individual may be contacted. In the embodiment of FIGS. 2–3, the contact information includes the company name, as well as phone and fax numbers. Alternately, an e-mail address, mailing address, or other selected contact information may be placed on the label, depending on the preferences of the individual. As a further variation, one or more of the labels may have one type of contact information (such as phone numbers, which can be placed in a person's personal phone directory) while another one or more of the labels may have another type of contact information (such as a mailing address which can be placed in a correspondence file).

Figure 4:
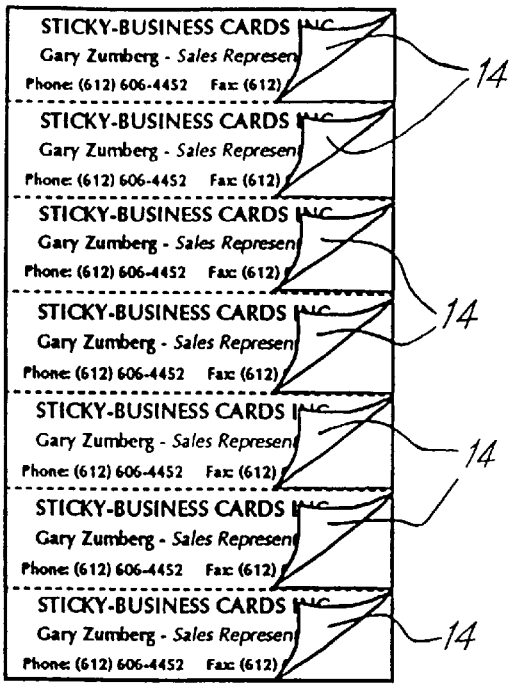
FIG. 4 is a plan view of the bottom surface of an alternate embodiment of a business card of the invention.
Figure 5:
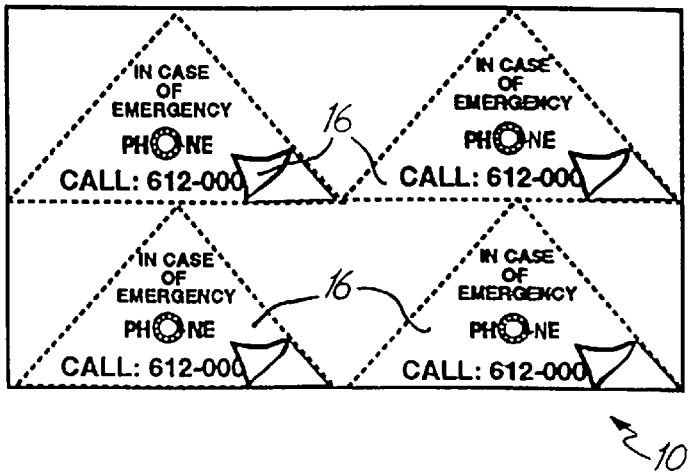
FIG. 5 is a plan view of the bottom surface of another alternate embodiment of a business card of the invention.

In FIG. 3 the card 10 is illustrated with four labels 12 extending along the length of the business card 10. FIG. 4 shows a variation in which seven smaller labels 14 extend across the width of the card 10. Other shapes and sizes may also be utilized as desired, such as the triangular labels 16 of FIG. 5. Preferably the entire bottom surface of the card 10 is covered by the labels to present a smooth finished surface.

Figure 6:
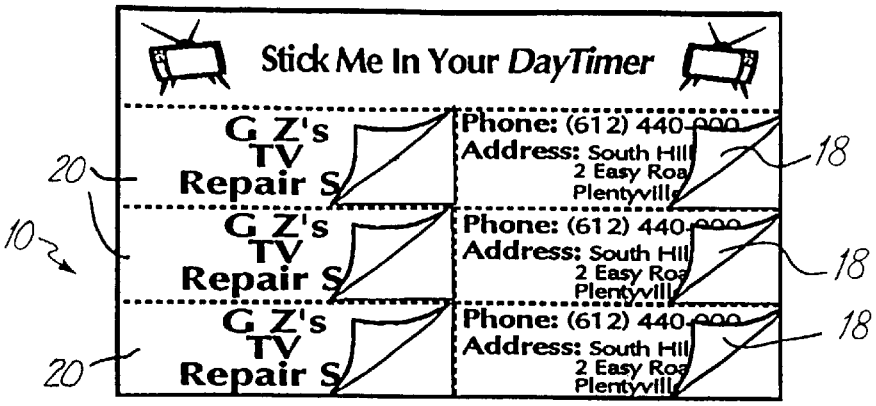
FIGS. 6–9 are plan views of the bottom surface of additional alternate embodiments of business cards of the invention.
Figure 7:
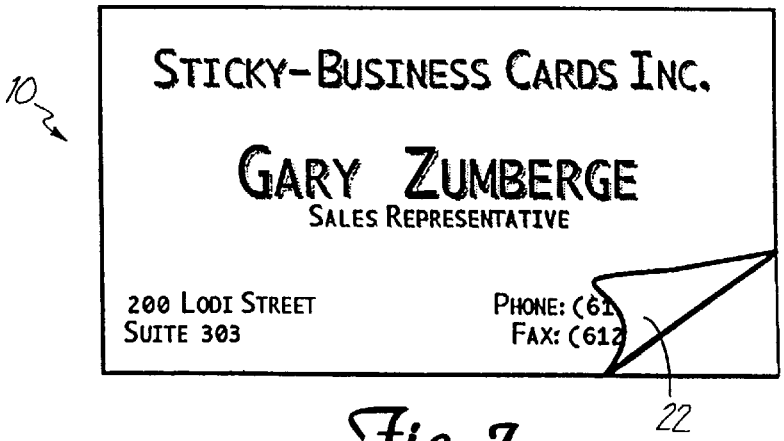

FIG. 6 illustrates yet another embodiment in which three labels 20 are provided with one type of identification information (the company name), and three additional labels 18 contain another type of identification information (phone number and address), giving the recipient of the card 10 additional options in where and how to use the labels. FIG. 7 shows a card in which the label 22 covers the entire bottom surface of the card.

Figure 8:
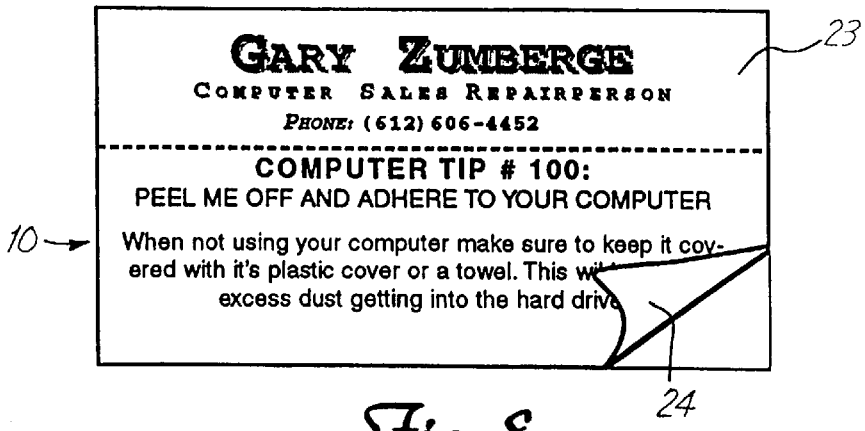
Figure 9:
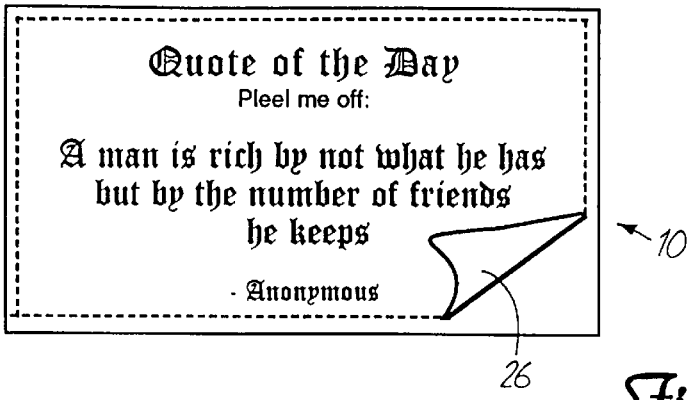

The invention may also utilize other types of information on the labels. For example, FIG. 8 shows a label 23 covering a portion of the bottom surface of the card 10, and a second, different label 24 containing technical tips that the recipient may place in convenient locations. FIG. 9 shows a label 26 containing other useful information, such as a quote of the day, a joke, or the like.

Figure 10:
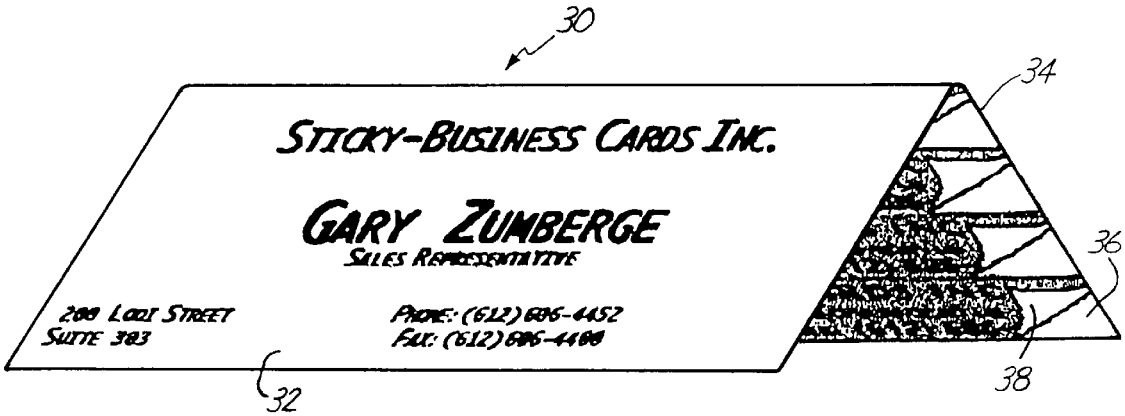
FIG. 10 is a perspective view of an alternate embodiment of the a tent-style business card of the invention.

FIG. 10 illustrates an alternate embodiment of the invention in which the business card is a tent-style business card 30. The card is formed from a piece of cardstock having a width and length essentially twice the size of a regular business card (i.e., not more than about 4.5 inches by about 3.75 inches, and typically about 4 inches by about 3.5 inches), so that when the card is folded in half it has a size of a regular business card (i.e., not more than about 2.25 inches by about 3.75 inches, and preferably about 2 inches by about 3.5 inches). The folded card 30, in its folded configuration, has top and bottom outer surfaces 32 and 34, respectively, and an inner surface 36. Business card identification information, including at least an individual's name and contact information identifying how one may contact the individual, is printed on the top outer surface 32.

At least one removable label 38 (and preferably a plurality of removable labels 38) are secured to the inner surface 36 of the card 30, the label(s) 38 including front and back sides and an adhesive applied to the back side to secure the label(s) to the inner surface 36 of the card 30. The label(s) have at least some of the business card identification information printed thereon, preferably at least the individual's name and at least some of the contact information. One or more removable labels may also be secured to the bottom outer surface 34 of the card 30, such label(s) similarly desirably including either some of the business card identification information or other useful information, such as a quote of the day, a joke, other information about the individual or his or her company, or the like.

Business cards in accordance with the invention may be made in a variety of convenient ways. For example, blank card-stock may be prepared with labels preadhered, and such card-stock may then be printed on both sides with the desired information. Alternately, card-stock may be printed on one side, and adhesive-backed labels may be separately printed and then secured to the card-stock, either by the printer or by the business person.

Attachment of the adhesive backed labels to the card-stock may be accomplished in any suitable fashion. For example, the adhesive backed labels may be adhered to a suitable release liner which in turn is securely attached to the card-stock (such as by a suitable permanent adhesive). The user then peels the label off of the release liner, which is left adhered to the bottom of the business card. Alternately, adhesive-backed labels may be prepared using a repositionable-type adhesive (such as the type used on 3M® brand POST-IT NOTES® and other similar repositionable items), in which case the labels may be attached directly to the card-stock, thereby eliminating the need for a release liner.

Figure 11:
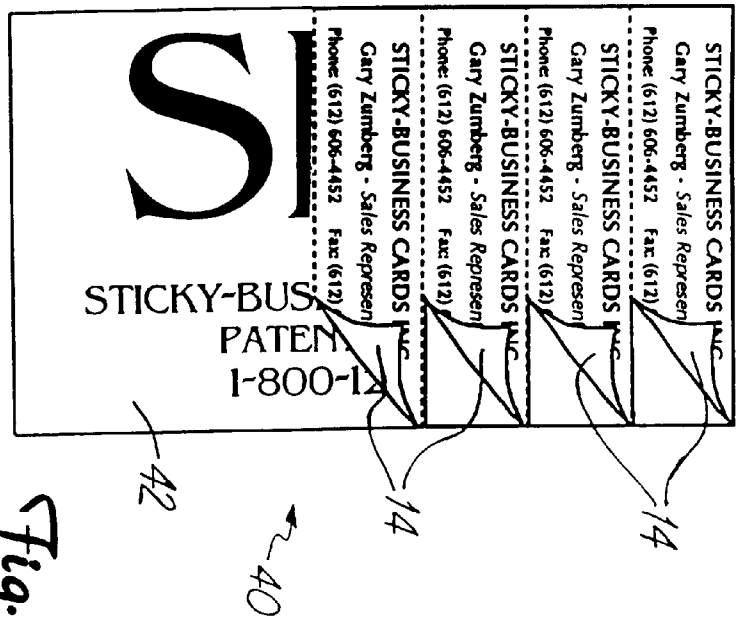
FIGS. 11 and 12 depict another embodiment which utilizes printing on a release liner.
Figure 12:
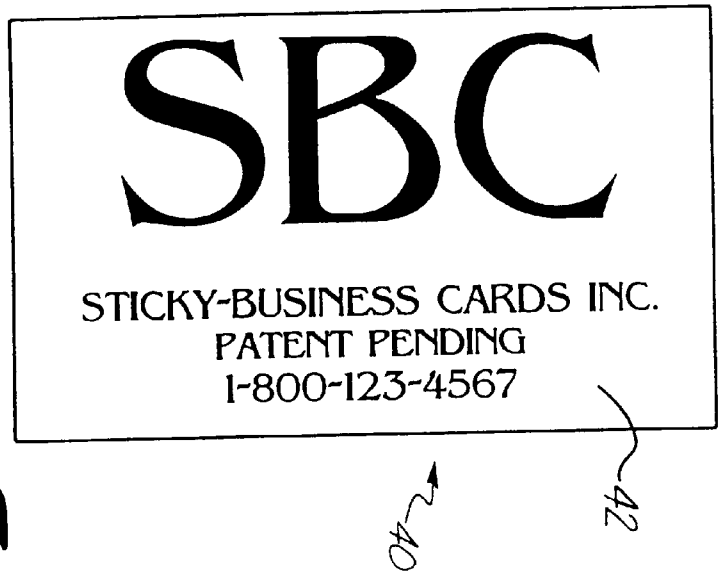

If a release liner is used, then it is possible to also print information on the release liner. This may be accomplished either by printing the information on the outer surface of the release liner, or, more preferably, a transparent release liner is used and the information is printed on the back of the card beneath the release liner (or on the inside surface of the release liner) so that the printing shows through the release liner. FIG. 11 shows the bottom surface of a card 40 similar to that depicted in FIG. 4, except that in FIG. 11 information has been printed on the release liner 42 and a number of the removable labels 14 have been removed, revealing a portion of the information printed on the release liner 42. FIG. 12 shows the bottom of the card 40, with all of the labels 14 removed, revealing the entire release liner 40. Thus, in this embodiment, there are three surfaces on which information may be printed—the top surface, the release liner 42 of the bottom surface, and the labels 14 attached to the release liner 42. If desired, the information printed on the release liner may be different in nature from the information printed on the front surface and on the labels. For example, the release liner may be printed with information identifying a supplier of the business card (e.g., either the printer of the business card, or the manufacturer of the paper stock from which the business card was made, or some other party involved in the manufacture or distribution of the business card). In this event, it may be desirable to print such information on the release liner with less color density (e.g., by using a very light colored ink, or a low percentage screen), so that the information is identifiable to the careful observer but otherwise is unobtrusive (not unlike a watermark on other types of stationery products).

Typically a printer of business cards will supply the completed business card assembly (including attached, printed labels) to the customer. Labels may also be prepared and sold separately, however. In such a situation a customer may be provided with a supply of regular business cards and a separate supply of corresponding printed labels. The customer may then place labels on the business cards as needed. Such labels typically would be mounted on a suitable release liner which has adhesive on its back covered with a second release liner. The user removes the second release liner and attaches the first release liner (with the labels) to the back of the business card, thus completing the construction of the business card assembly of the invention. The completed card may then be used as described above.

Regardless of the method of construction of the multiple-use business card assembly of the invention, a business person receiving a multiple-use business card of the invention may use the peel off labels in a variety of ways. Labels may be peeled off and placed in a personal planner, or in a file relating to the person identified on the business card, or on conventional ROLODEX®-style card, or in any other desired location. Business people with multiple offices may wish to peel off the labels and place them in individual directories that remain at multiple offices, thus making the information on a single business card available to the business person at multiple offices without having to manually copy the information off the card. Moreover, if an acquaintance asks the business person for a referral to one of the business person's contacts, the business person can simply peel off one of the labels from the contact's multiple-use business card and give it to the acquaintance. The business person will still have the original business card from the contact, and the acquaintance will have accurate information about how to get in touch with the contact, all without having to copy the information off of the business card.

While a preferred embodiment of the present invention has been described, it should be understood that various changes, adaptations and modifications may be made therein without departing from the spirit of the invention and the scope of the appended claims.

What is claimed is:

1. A tent-style business card assembly comprising:

a card formed from a piece of cardstock having a width and length of not more than about 4.5 inches by about 3.75 inches, the card being folded substantially in half to a size of not more than about 2.25 inches by about 3.75 inches, the folded card having top and bottom outer surfaces and an inner surface, business card identification information, including at least an individual's name and contact information identifying how one may contact the individual, being printed on the top outer surface;

at least one removable label secured to the inner surface of the card, the label including front and back sides and an adhesive applied to the back side to secure the label to the inner surface of the card;

at least one removable label secured to the bottom outer surface of the card, the label including front and back sides and an adhesive applied to the back side to secure the label to the outer surface of the card; and at least one of the labels having at least some of the business card identification information printed thereon, including at least the individual's name and at least some of the contact information.

2. A business card assembly comprising:

a wallet-sized card having top and bottom surfaces, business card identification information being printed on the top surface;

a release liner secured to the bottom surface of the card; and one or more adhesive-backed removable labels secured to the release liner;

each of the labels having information printed thereon and the release liner also have information printed thereon or thereunder so that removal of the labels exposes the information printed on or under the release liner.

3. The business card assembly of claim 2, wherein the information printed on at least some of the labels includes at least some of the business card identification information printed on the top surface.

4. The business card assembly of claim 2, wherein the information printed on or under the release liner includes at least some of the business card identification information printed on the top surface.

5. The business card assembly of claim 2, wherein the information printed on or under the release liner includes information identifying a supplier of the business card.

6. The business card assembly of claim 2, wherein the information printed on or under the release liner includes information identifying a supplier of the business card.

7. The business card of claim 2, wherein the information printed on or under the release liner is printed with less color density than that of the information printed on the top surface of the business card.

* * * * *